US007215080B2

(12) United States Patent
Minamoto et al.

(10) Patent No.: US 7,215,080 B2
(45) Date of Patent: May 8, 2007

(54) EXTERNAL ELECTRODE TYPE DISCHARGE LAMP AND METHOD OF MANUFACTURING THE SAME

(75) Inventors: Maki Minamoto, Tokyo (JP); Seiichiro Fujioka, Tokyo (JP)

(73) Assignee: NEC Corporation, Tokyo (JP)

( * ) Notice: Subject to any disclaimer, the term of this patent is extended or adjusted under 35 U.S.C. 154(b) by 3 days.

(21) Appl. No.: 11/071,841

(22) Filed: Mar. 4, 2005

(65) Prior Publication Data

US 2005/0194903 A1 Sep. 8, 2005

(30) Foreign Application Priority Data

Mar. 5, 2004 (JP) ..... 2004-062719
Mar. 16, 2004 (JP) ..... 2004-075070

(51) Int. Cl.
*H01J 11/00* (2006.01)
*H01J 61/06* (2006.01)
*H01J 65/00* (2006.01)

(52) U.S. Cl. ..... 313/607; 313/594; 313/234

(58) Field of Classification Search ..... 313/607, 313/594, 234, 631, 635
See application file for complete search history.

(56) References Cited

U.S. PATENT DOCUMENTS 5,514,934 A * 5/1996 Matsumoto et al. ..... 313/607
5,581,152 A * 12/1996 Matsuno et al. ..... 313/634
5,903,095 A * 5/1999 Yoshida et al. ..... 313/485
6,407,513 B1 * 6/2002 Vollkommer et al. ..... 315/246
6,515,433 B1 * 2/2003 Ge et al. ..... 315/227 R
6,810,208 B2 * 10/2004 Saiki et al. ..... 396/155
2004/0178731 A1 * 9/2004 Takeda et al. ..... 313/607

FOREIGN PATENT DOCUMENTS

| | | | |
|---|---|---|---|
| CN | 554368 | | 9/2003 |
| JP | 5-217560 | * | 8/1993 |
| JP | 11-354079 | | 12/1999 |
| JP | 2002-216704 | | 8/2002 |
| JP | 304972-2002 | | 10/2002 |
| JP | 2003-91007 | | 3/2003 |
| KR | 2001-0083185 | | 8/2001 |
| KR | 2004-0014945 | | 2/2004 |

* cited by examiner

*Primary Examiner*—Ashok Patel
(74) *Attorney, Agent, or Firm*—Young & Thompson

(57) ABSTRACT

In an external electrode type discharge lamp, a gadolinium oxide film obtained by baking solution containing at least one of gadolinium octate and gadolinium propionate is provided in a portion including at least a portion corresponding to an external electrode.

9 Claims, 6 Drawing Sheets

PRIOR ART

EXTERNAL ELECTRODE TYPE DISCHARGE LAMP AND METHOD OF MANUFACTURING THE SAME

BACKGROUND OF THE INVENTION

1. Field of the Invention

The present invention relates to an external electrode type discharge lamp and a method of manufacturing the same, and more particularly to an external electrode type discharge lamp which is effective for preventing a glass envelope just below external electrodes from being perforated, and to a method of manufacturing the same.

2. Description of the Related Art

As for a discharge lamp, gas is encapsulated into a transparent hollow airtight envelope, and discharge is caused in the envelope, and light radiated by the discharge is taken out to the outside of the envelope, thus using the light for illumination. The discharge lamps include an internal electrode type in which electrodes are provided in an envelope causing discharge, and an external electrode type.

Among these discharge lamps, the external electrode type discharge lamp has a structural feature in that the electrodes are provided outside the envelope, and is also called a non-electrode discharge lamp because no electrodes are provided in the envelope. The external electrode type discharge lamp has the following many advantages compared to the internal electrode type discharge lamp. Since it is unnecessary to seal a lead communicating from the outside of the envelope to the inside of the envelope, the manufacture of the external electrode type discharge lamp is easy. Since the envelope can be formed to the form of a thin tube or to be thin, the external electrode type discharge lamp has the advantage in its compact size. Since the electrodes are not damaged due to electron attack during lighting-up and blurs of the inside of the discharge envelope due to sputtering of the electrode do not occur, a probability of shortening of a lifetime at the time blinking and lighting are repeated is small. Thus, the external electrode type discharge lamp is used for various applications including a light source of a backlight for liquid crystal displays and a light source for radiating light onto an original manuscript in various kinds of OA machines such as photocopying machines, facsimile apparatus, and image scanners.

Glass is mainly used for the discharge envelope, and often cylindrical. There are many sorts of shapes in the electrode, and a pair of ring-shaped electrodes encircling the outside of the cylindrical glass envelope along its circumference are arranged at intervals in a longitudinal direction of the glass envelope. This discharge envelope is called a ring type. Alternatively, there is a discharge envelope called an aperture type, in which two band-shaped electrodes extending along a longitudinal direction of the glass envelope arranged so as to be spaced from each other along a circumference of the glass envelope. Furthermore, a discharge envelope is conceived, in which parallel two elongate electrodes encircle spirally a cylindrical glass envelope (called a spiral type).

The inventors of the present invention found phenomenon that in a conventional external electrode type discharge lamp, a hole begins to open at a portion just below an external electrode of a glass envelope from within the glass envelope with the course of lighting-up time, and the hole becomes large so that the edge of the hole reaches the external surface of the glass envelope, leading to incapability of keeping air-tight of the glass envelope. This "hole-perforation" phenomenon is particularly remarkable when mercury gas is contained in gas as discharge medium, and the inventors of the present invention confirmed that this phenomenon appears at an early stage, and that also a rate of progress of the phenomenon is fast.

It is proved that this phenomenon can be reduced by lowering a high frequency AC voltage to be applied between the external electrodes. However, although a lifetime characteristic is slightly improved by lowering the voltage, another problem occurs that a brightness of a lamp decreases by just that much.

SUMMARY OF THE INVENTION

Accordingly, an exemplary feature of the present invention is to provide an external electrode type discharge lamp capable of reducing a possibility of opening a hole, at a portion just below an external electrode of a glass envelope even when lighting-up is performed with an equal voltage to that applied to a conventional electrode, and to provide a method of manufacturing the same.

An external electrode type discharge lamp of the present invention comprises a hollow airtight glass envelope encapsulating gas as discharge medium; a pair of electrodes provided on an external surface of the glass envelope, to which a voltage causing discharge in the glass envelope is applied; and a non-porous oxide film provided in a portion of an internal surface of the glass envelope, the portion including at least a portion opposite to each of the external electrodes.

The non-porous oxide film is preferably made of any one of gadolinium oxide and magnesium oxide.

The non-porous oxide film is preferably formed by baking any one of gadolinium octate solution, gadolinium propionate solution, mixture solution of gadolinium octate and gadolinium propionate, magnesium acetate solution, magnesium nitrate solution, and mixture solution of magnesium acetate and magnesium nitrate.

The non-porous oxide film is preferably provided on the entire of the internal surface of the glass envelope.

A phosphor layer is preferably formed on the non-porous oxide film.

The gas as the discharge medium preferably contains mercury gas.

The pair of electrodes preferably take any one of a ring shape in which the electrodes encircle a circumference of the glass envelope, a band shape in which the electrodes extend along a longitudinal direction of the glass envelope, and a spiral shape in which the electrodes are wounded in the longitudinal direction of the glass envelope.

Another external electrode type discharge lamp of the present invention comprises a hollow airtight glass envelope encapsulating gas as discharge medium; a pair of electrodes provided on an external surface of the glass envelope, to which a voltage causing discharge in the glass envelope is applied; and a oxide film having a continuous structure, provided in a portion of an internal surface of the glass envelope, the portion including at least a portion opposite to each of the external electrodes.

The oxide film having the continuous structure is preferably made of any one of gadolinium oxide and magnesium oxide.

The oxide film having the continuous structure is preferably formed by baking any one of gadolinium octate solution, gadolinium propionate solution, mixture solution of gadolinium octate and gadolinium propionate, magnesium acetate solution, magnesium nitrate solution, and mixture solution of magnesium acetate and magnesium nitrate.

The oxide film having the continuous structure is preferably made of any one of gadolinium oxide and magnesium oxide.

The oxide film having the continuous structure is preferably formed by baking any one of gadolinium octate solution, gadolinium propionate solution, and mixture solution of gadolinium octate and gadolinium propionate.

The oxide film having the continuous structure is preferably formed by baking any one of magnesium acetate solution, magnesium nitrate solution, and mixture solution of magnesium acetate and magnesium nitrate.

The oxide film having the continuous structure is preferably provided on the entire of the internal surface of the glass envelope.

A phosphor layer is preferably formed on the oxide film having the continuous structure.

The gas as the discharge medium preferably contains mercury gas.

The pair of electrodes preferably take any one of a ring shape in which the electrodes encircle a circumference of the glass envelope, a band shape in which the electrodes extend along a longitudinal direction of the glass envelope, and a spiral shape in which the electrodes are wounded along the longitudinal direction of the glass envelope.

According to the external electrode type discharge lamp of the present invention, even if the voltage causing the discharge in the glass envelope is applied between the pair of the external electrodes so that the discharge lamp emits light, the oxide film having the continuous structure, provided in the portion including the portion opposite to each of the external electrodes, acts as a protection film, and it is possible to suppress a perforation of a hole in a portion just below the external electrode of the glass envelope. Since such a perforation of the hole can be prevented, the application voltage needs not be decreased, and a high brightness light-emission with a long life time can be realized.

Furthermore, a method of manufacturing an external electrode type discharge lamp comprises: preparing a glass envelope having both open end faces; forming a pair of external electrodes on an external surface of the glass envelope; forming a non-porous oxide film in a portion of an internal surface of the glass envelope, the portion including at least a portion opposite to each of the external electrodes; and sealing the both open faces of the glass envelope after filling gas as discharge medium in the glass envelope.

The non-porous oxide film is a non-porous gadolinium oxide film.

The oxide film is formed by baking any one of gadolinium octate solution, gadolinium propionate solution, and mixture solution of gadolinium octate and gadolinium propionate.

The method of an external electrode type discharge lamp further comprises forming a phosphor layer in the glass envelope.

The non-porous gadolinium oxide film is provided on the entire of the internal surface of the glass envelope.

The non-porous magnesium oxide film is formed by baking any one of magnesium acetate solution, magnesium nitrate solution, and mixture solution of magnesium acetate and magnesium nitrate.

The method of manufacturing an external electrode type discharge lamp further comprises forming a phosphor layer in the glass envelope.

The non-porous magnesium oxide film is provided on the entire of the internal surface of the glass envelope.

According to the method of manufacturing an external electrode type discharge lamp of the present invention, the dense oxide film having the continuous structure can be formed in the portion including at least the portion opposite to each of the external electrodes. By baking the solution containing a material for the oxide film, the dense oxide film having the continuous structure is formed. Thus, even if the voltage causing the discharge in the glass envelope is applied between the pair of the external electrode, the non-porous oxide film provided acts as a protection film, and a perforation of a hole in the portion of the glass envelope just below the external electrode can be suppressed. Since such a perforation of the hole can be prevented, the application voltage needs not to be decreased, and a high brightness light-emission with a long life time can be realized.

BRIEF DESCRIPTION OF THE DRAWINGS

These and other exemplary features and advantages and further description of the invention will be more apparent to those skilled in the art by reference to the description, taken in connection with the accompanying drawings, in which.

DETAILED DESCRIPTION OF THE PREFERRED EMBODIMENTS

Before preferable embodiments of the present invention are described, prior arts and problems to be solved by the present invention will be described in detail with reference to the accompanying drawings.

Figure 1A:
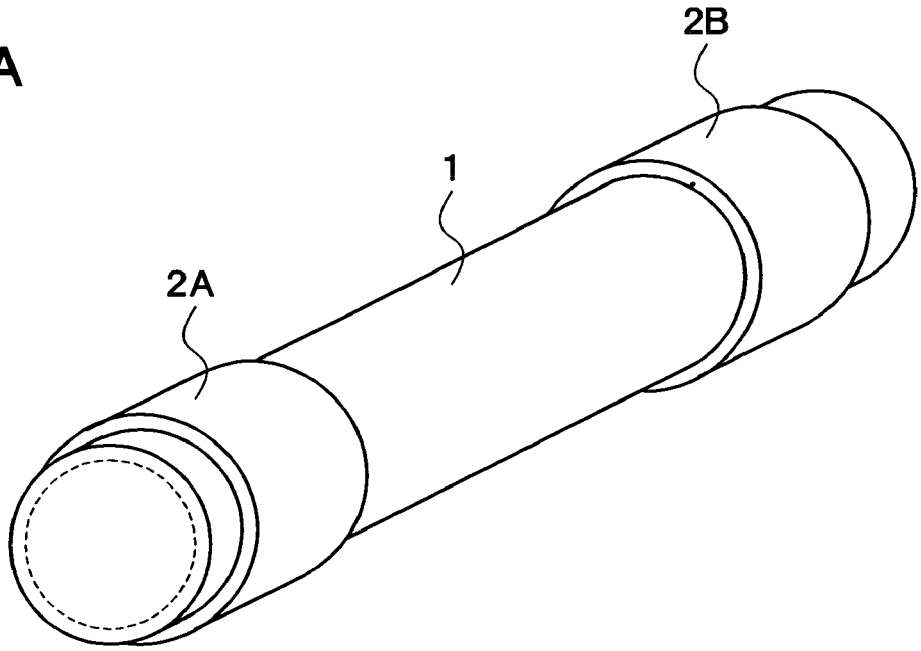
FIG. 1A is a perspective view of a conventional external electrode type discharge lamp.
Figure 1B:
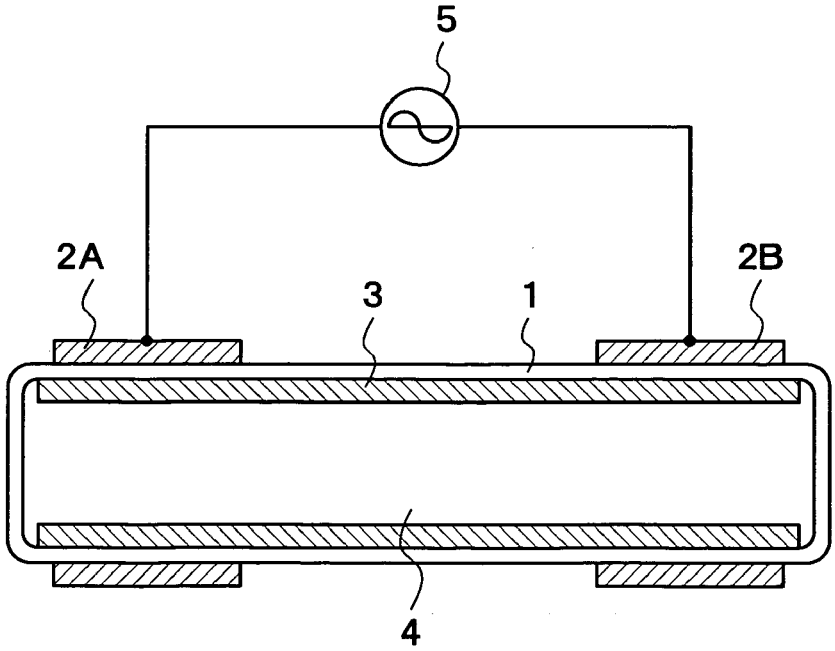
PRIOR ART FIG. 1B
FIG. 1B is a section view of the convention external electrode type discharge lamp.

In a discharge lamp shown in FIGS. 1A and 1B, a pair of ring-shaped external electrodes 2A and 2B encircling a circumference of a sealed cylindrical glass envelope 1 are provided on an external surface of the glass envelope 1 in the vicinity of both ends thereof. A metal is often used for the electrodes. Sometimes, a transparent conductive material such as ITO is used, or this material and a metal are used in combination with each other.

Mixed gas of mercury (Hg) gas and inert gas, such as xenon (Xe) or argon (Ar), is encapsulated at a pressure of, for example, about 2×103 to 15×103 Pa (15 to 113 Torr) in a space inside the glass envelope 1 for discharge medium. A phosphor layer 3 is formed on an internal surface of the glass envelope 1, if necessary. Inert gas is sometimes used alone for the discharge medium without including mercury (Hg). This is a well known inert gas discharge lamp.

In the external electrode type discharge lamp, an AC voltage having a high frequency of 25 kHz and a high voltage of about 2500 V, which has the form of sine wave or pulse wave, is applied between the external electrodes 2A and 2B from a lamp driving circuit 5. Upon application of the voltage, in the glass envelope 1 made of a dielectric material, dielectric polarization occurs at glass surface just below the external electrodes 2A and 2B, and an internal surface of portions of the glass corresponding to the external electrodes 2A and 2B act as an electrode. Thus, a high voltage is introduced to the inside of the glass envelope 1, and dielectric barrier discharge occurs in the glass envelope 1. Mercury in the gas 4 as the discharge medium radiate's ultraviolet ray by the dielectric barrier discharge, and the phosphor layer 3 is excited by the ultraviolet ray radiated by the mercury, and emits light having a wavelength different from that of the exciting ultraviolet ray, such as visible light. The light emitted by the phosphor layer 3, which has been undergone the wavelength change, is radiated to the outside through the transparent glass envelope 1. For example, when ultraviolet ray of a mercury emission line such as sterilization bactericidal light, for example, is used in situ, the phosphor layer 3 is not provided, and ultraviolet light radiated by mercury is taken out through the glass envelope 1 in situ.

As described above, the external electrode type discharge lamp differs from so-called a cold cathode lamp and a hot cathode lamp in view of electrode arrangement, which have electrodes provided in the vicinity of both internal ends of a lamp envelope. Moreover, the role of the glass envelope in the external electrode type discharge lamp is highly different from those of the cold cathode lamp and the hot cathode lamp, because the portions of the internal surface of the glass envelope just below the external electrodes 2A and 2B act as the electrode. The conventional discharge lamp described above is proposed in Japanese Laid-Open Patent No. 2002-216704.

The inventors of the present invention found phenomenon that in the above described conventional external electrode type discharge lamp, a hole begins to perforate at a portion just below each of external electrodes 2A and 2B of the glass envelope 1 from within the glass envelope 1 with the course of lighting-up time, the hole becomes large so that the hole reaches the external surface of the glass envelope 1, leading to incapability of keeping air-tight of the glass envelope 1. This "hole-perforation" phenomenon is particularly remarkable when mercury gas is added in the gas 4 as the discharge medium, and this phenomenon appeared at an early stage. Also progress speed of the hole-perforation is fast, when the mercury gas is added to the discharge medium. It is proved that this phenomenon can be reduced by lowering a high frequency AC voltage to be applied between the external electrodes 2A and 2B. However, although a lifetime characteristic is slightly improved by lowering the voltage, a brightness of a lamp decreases by just that much. Specifically, it is impossible to satisfy both of suppression of the hole-perforation phenomenon and a high brightness of the lamp.

First Exemplary Embodiment

Figure 2:
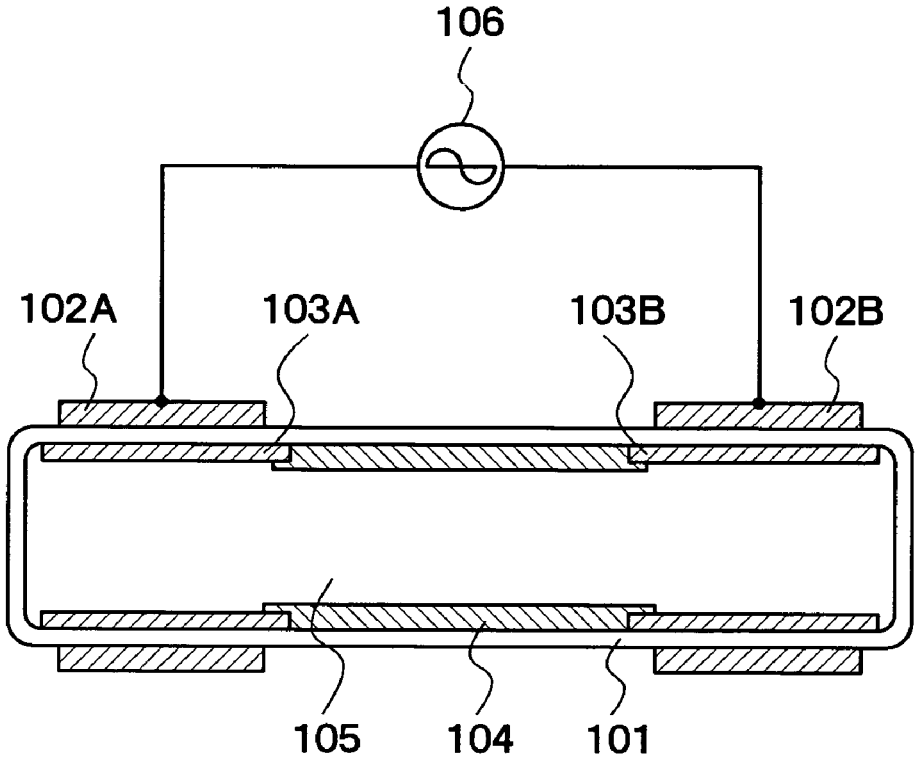
FIG. 2 is a section view of an external electrode type discharge lamp of a first exemplary embodiment of the present invention.

Next, an external electrode type discharge lamp of a first exemplary embodiment of the present invention will be described with reference to FIG. 2. External appearance of the external electrode type discharge lamp of this embodiment is the same as that of the conventional mercury fluorescent lamp. Internal structure of the discharge lamp of the embodiment is different from the conventional discharge lamp. A pair of ring-shaped external electrodes 102A and 102B encircling a sealed cylindrical glass envelope 101 along its circumference are provided on its external surface in the vicinity of both ends thereof. Borosilicate glass containing K2O.B2O3.SiO2. is used for the glass envelope 101. In general, although a metal material is often used for the electrodes, a transparent conductive material such as ITO (Indium Thin Oxide) is sometimes used, and the transparent conductive material is sometimes used in combination with the metal material.

The external electrode type discharge lamp of this embodiment of the present invention differs from the convention mercury fluorescent lamp in that non-porous gadolinium oxide (Gd2O3) films 103A and 103B are formed at portions on internal surface of the glass envelope 101 just below the external electrodes 102A and 102B. These gadolinium oxide films 103A and 103B are obtained by baking any one of gadolinium octate solution, gadolinium propionate solution, and mixture solution of gadolinium octate and gadolinium propionate, and provided on an internal surface of the glass envelope 101 so as to be ring-shaped.

Furthermore, a phosphor layer 104 is formed on parts of the ring-shaped gadolinium oxide films 103A and 103B and on a portion of the internal surface of the glass envelope 101 between the films 103A and 103B, which is not covered with the films 103A and 103B. Furthermore, as gas 105 as discharge medium, mixed gas of mercury (Hg) gas and inert gas such as xenon (Xe) and argon (Ar) is encapsulated at a pressure of, for example, about 2×103 to 15×103 Pa (15 to 113 Torr) in a space within the glass envelope 101. As the gas 105 as the discharge medium, only inert gas containing no mercury is sometimes used.

Figure 3A:
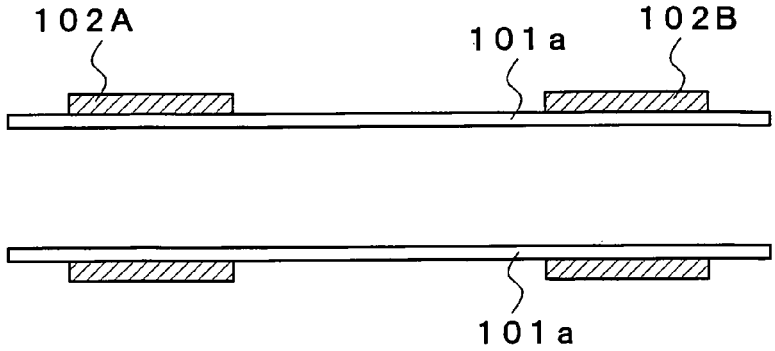
FIGS. 3A–3D are sectional views showing manufacturing steps of the external electrode type discharge lamp of the first embodiment of the present invention.
Figure 3B:
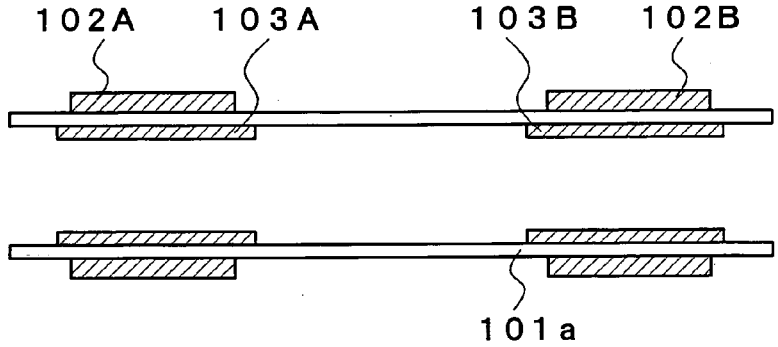

Next, a method of manufacturing the external electrode type discharge lamp of the first embodiment of the present invention will be described with reference to the accompanying drawings. The inventors of the present invention fabricated an external electrode type mercury fluorescent lamp of the first embodiment shown in FIG. 2 in the following manner. First, as shown in FIG. 3A, a tubular glass body 101*a* having both open end faces is prepared, and conductive paste is coated onto portions of an external surface on both ends of the glass body 101*a*, followed by baking the conductive paste. Thus, the ring-shaped external electrodes 102A and 102B are formed. Subsequently, as shown in FIG. 3B, gadolinium octate solution is coated onto respective portions of the internal surface of the glass body 101*a* opposite to the external electrodes 102A and 102B, and solvent is vaporized by applying heat to the solution. In order to selectively coat the gadolinium octate solution onto the internal surface of the glass body 101*a*, an area which needed not be coated with the gadolinium octate solution is previously covered with a mask. Furthermore, by baking the gadolinium octate solution at a temperature of about 500 to 600° C. in the atmosphere, the gadolinium oxide films 103A and 103B are formed. The gadolinium octate solution used in this embodiment is prepared in such a manner that gadolinium octate is dissolved into alcohol solvent such as butanol, ethanol, or propanol, or aqueous solvent such as pure water, and its viscosity is adjusted. The gadolinium oxide films 103A and 103B formed on the internal surface of the glass body 101*a* are translucent, which are a dense continuous film having a structure in which its constituents are continuously contained.

Figure 3C:
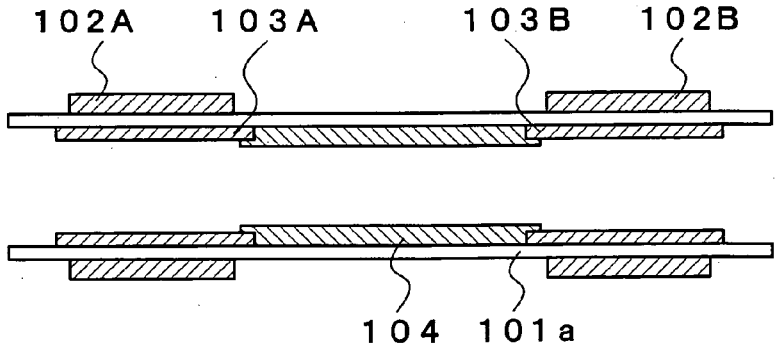
Figure 3D:
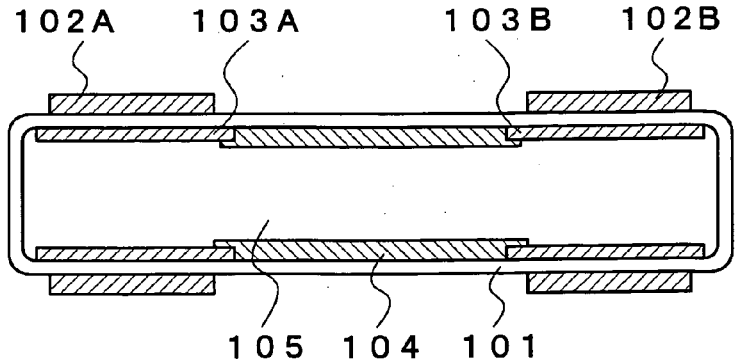

Thereafter, as shown in FIG. 3C, the phosphor layer 104 is formed on the parts of the ring-shaped gadolinium oxide films 103A and 103B and on the internal surface of the glass body 101*a* between the gadolinium oxide films 103A and 103B, which is not covered with the films 103A and 103B. Furthermore, as shown in FIG. 3D, after the air is once evacuated from the glass body 101*a*, the glass body 101*a* is filled with the xenon (Xe) gas containing the mercury (Hg) gas, which is the gas 105 as the discharge medium. Then, the both ends of the glass body 101*a* is sealed to form the glass envelope 100. In such a manner, the external electrode type mercury fluorescent lamp of this embodiment shown in FIG. 2 is completed.

As to the formation of the external electrodes 102A and 102B, since the electrodes 102A and 102B are formed, for example, by baking the conductive paste in the above described embodiment, the external electrodes 102A and 102B are first formed. There is phosphor material used for the phosphor layer 104, easy to change its characteristic by heat. Accordingly, when a method requiring heating for forming the external electrode is adopted, it is preferable to form the external electrode prior to the formation of the phosphor layer 104. As the external electrodes 102A and 102B, a metal film such as aluminum foil is used, and this metal film is bonded to the external surface of the glass envelope 101 by means of adhesion, whereby it is possible to form the external electrode after the formation of the phosphor layer 104. Specifically, after the phosphor layer 104 is formed, the external electrodes are formed before the gas 105 as the discharge medium is encapsulated. Alternatively, after the gas 105 as the discharge medium is encapsulated, the external electrodes may be formed finally.

Next, a first modification of the above described external electrode type discharge lamp of the first embodiment and a method of manufacturing the same will be described. This modification has a feature in that the gadolinium oxide films 103A and 103B are formed on the internal surface of the glass envelope 101 by use of gadolinium propionate solution. A structure and a method of manufacturing such a structure other than the structure of the films 103A and 103B and the formation thereof are the same as those of the first embodiment. In this modification, the gadolinium propionate solution is coated onto respective portions of the internal surface of the glass envelope 101 opposite to the external electrodes 102A and 102B, and solvent is vaporized by applying heat to the solution. Furthermore, by baking the gadolinium propionate solution at a temperature of about 500 to 600° C. in the atmosphere, the gadolinium oxide films 103A and 13B are formed. The gadolinium propionate solution used in this modification is prepared in such a manner that gadolinium propionate is dissolved into suitable solvent, and its viscosity is adjusted. Thus, the gadolinium propionate solution is prepared. The gadolinium oxide films 103A and 103B formed in the above described manner are non-porous, which are a dense continuous film having a structure in which its constituents are continuously contained.

Similar to the case of the conventional mercury fluorescent lamp, the external electrode type mercury fluorescent lamp according to the first embodiment and the first modification performs the discharge and the light-emission by being applied with an AC voltage having a high frequency and a high voltage from the lamp driving circuit 106 to the pair of the external electrodes 102A and 102B. However, in any of the first embodiment and the first modification, the hole-perforation phenomenon of the glass envelope did not occur in the portions of the external surface of the glass envelope 101 just below the external electrodes 102A and 102B. While there have been heretofore fluorescent lamps causing an inability in lighting instantaneously due to the hole-perforation of the glass envelope at the time about 3000 hours has passed after staring the discharge, a change in the internal surface of the glass envelope 101, which is confirmed visually, is not recognized within about 3000 hours, in the first embodiment.

The reason for this is considered as the follows. As described above, in the external electrode type discharge lamp, the portions of the internal surface of the glass envelope 101 just below the external electrodes 102A and 102B act as the electrode during the discharge. Accordingly, during the lighting, mercury ions are accelerated to be strongly bombarded into the portions of the internal surface of the glass envelope acting as the electrode, and sputter etching occurs. When the portions of the internal surface of the glass envelope are exposed, or alternately when a phosphor layer is directly formed on the internal surface of the glass envelope, the mercury ions etch the internal surface of the glass envelope by sputtering, and penetrate into the inside of the internal surface thereof. Repetition of the sputter etching and penetration of the mercury ions reduces the thickness of the glass envelope, and simultaneously elevates a temperature therein, thus decreasing a withstand voltage. Therefore, discharge current increases locally. Thereafter, a thermal runaway rapidly occurs by a positive feedback which means the decrease in the withstand voltage and the increase in the discharge current, and a hole is perforated through the glass envelope finally.

Contrary to this, in the foregoing discharge lamp of the first embodiment, the gadolinium oxide films 103A and 103B act as a protection film for preventing the accelerated mercury ions from being sputtered onto the glass envelope, and can suppress the hole-perforation phenomenon of the glass envelope. Herein, it is important that the gadolinium oxide films 103A and 103B are a dense film having a continuous structure. Specifically, for several metal oxides, the inventors of the present invention tried to use a film formed of metal oxide powders for the protection film. In the same manner as that in which a phosphor layer, for example, is formed, the metal oxide powders are dispersed into solvent, and slip is prepared by adding binder. The slip is coated onto the internal surface of the glass envelope 101, and dried, thus forming the protection film. However, in the case of the protection film formed of powders, mercury is adsorbed in a space between particles of the film, and an amount of the mercury in the gas 105 as the discharge medium formed of mixed gas containing mercury and xenon decreased with the course of discharge time. A side effect of a short lifetime of the lamp caused by the decrease in the amount of the mercury appeared. Furthermore, undesirable phenomenon that the mercury adsorbed in the space between the particles erodes the glass envelope is also recognized.

Contrary to this, in the first embodiment, the decrease in the amount of the mercury and the erosion of the glass envelope did not occur. This is because the gadolinium oxide film in the first embodiment is a dense film having a continuous structure. In view of the capability to prevent the sputter etching by the accelerated mercury ions to the glass envelope, it is expected that the film having the continuous structure has a higher capability of preventing the sputter etching by the mercury ions to the glass envelope than the protection film formed by using the powders having a large number of spaces between the particles. In view of this, it is considered that the film having the continuous structure is suitable for the protection film against hole-perforation.

Note that in the external electrode type discharge lamp the sputter etching by the ions against the internal surface of the glass envelope, which acts as the electrode, naturally occurs even when the discharge medium is only made up of inert gas without including mercury. However, the reason why the hole-perforation phenomenon of the glass envelope is particularly significant is presumed as follows. Specifically, mercury ion is heavier than inert gas for the discharge lamp typified by Xe, Kr, Ar, Ne and the like, and shows a significant sputtering effect.

Next, an external electrode type discharge lamp and a method of manufacturing the same of a second modification of the first embodiment will be described. This modification has a feature in that, by use of solution obtained by mixing gadolinium octate and gadolinium propionate, gadolinium oxide films 103A and 103B are formed on an internal surface of a glass envelope 101. A structure and a method of manufacturing the same are the same as the first embodiment and the first modification of the first embodiment other than the structure of the gadolinium oxide films 103A and 103B and formation thereof. In this second modification, the solution obtained by mixing the gadolinium octate and the gadolinium propionate is coated onto portions opposite to external electrodes 102A and 102B, and solvent is vaporized by applying heat to the solution. Furthermore, by baking the solution in the atmosphere, the gadolinium oxide films 103A and 103B are formed. The solution in which the gadolinium octate and the gadolinium propionate are mixed is prepared by dissolving the gadolinium octate and the gadolinium propionate into suitable solvent and by adjusting its viscosity. It is confirmed that also the gadolinium oxide films formed in the above described manner exercised the effect to prevent the hole-perforation of the glass envelope as in the case of the gadolinium oxide film of the foregoing first embodiment and the first modification. Difference of effects owing to mixing ratio of the gadolinium octate and the gadolinium propionate between the gadolinium oxide films of the first embodiment and modification, and of the second modification is not recognized.

(Second Exemplary Embodiment)

Figure 4:
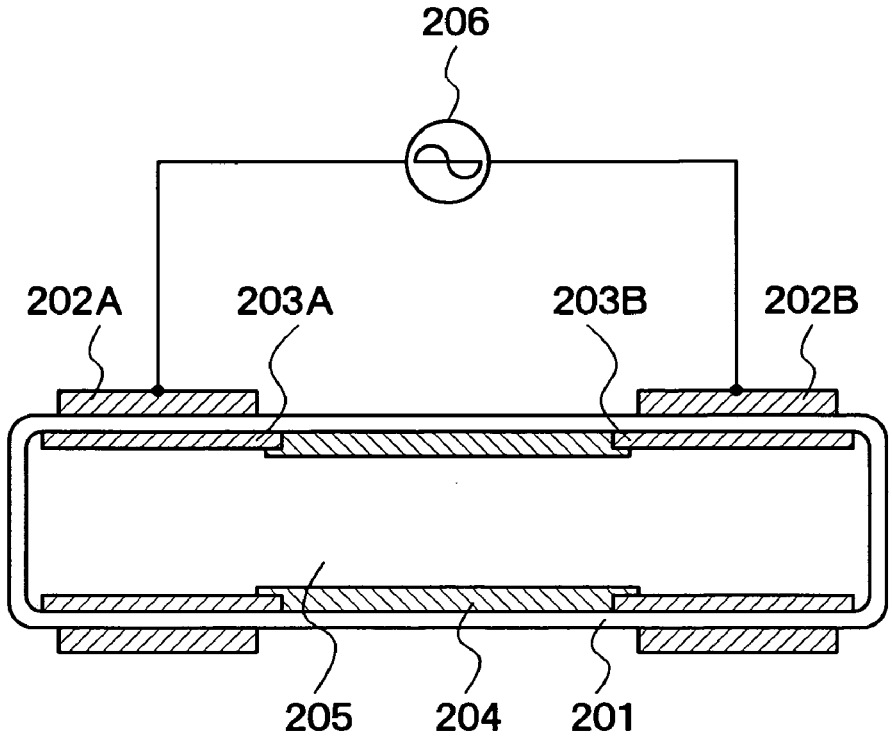
FIG. 4 is a sectional view of an external electrode type discharge lamp of a second exemplary embodiment of the present invention.

Next, referring to FIG. 4, an external electrode type discharge lamp of a second exemplary embodiment of the present invention will be described. The external electrode type discharge lamp of this embodiment has the same external appearance as those of the conventional mercury fluorescent lamp and the mercury fluorescent lamp of the first embodiment. Internal-structure of the discharge lamp of the embodiment is different from the conventional discharge lamp. A pair of ring-shaped external electrodes 202A and 202B encircling a sealed cylindrical glass envelope 201 along its circumferential direction are provided on portions of an external surface of the glass envelope 201 in the vicinity of both ends thereof. Borosilicate glass containing K2O.B2O3.SiO2 is used for the glass envelope 201. Although a metal material is generally used as a material of these electrodes, a transparent conductive material such as ITO is sometimes used, and the transparent conductive material is sometimes used in combination with the metal material.

The second embodiment of the present invention is different from the first embodiment in that non-porous magnesium oxide films (MgO) films 203A and 203B are respectively formed in portions of an internal surface of the glass envelope 201 just below the external electrodes 202A and 202B. These magnesium oxide films are obtained by baking any one of magnesium acetate solution and magnesium nitrate solution or by baking mixture solution of magnesium acetate and magnesium nitrate, and provided on the internal surface of the glass envelope 201 so as have a ring shape.

Furthermore, a phosphor layer 204 is formed on parts of the ring-shaped magnesium oxide films 203A and 203B and on a portion of the internal surface of the glass envelope 201 between the films 203A and 203B, which is not covered with the films 203A and 203B. Furthermore, as gas 205 as discharge medium, mixed gas of mercury (Hg) gas and inert gas such as xenon (Xe) and argon (Ar) is encapsulated at a pressure of, for example, about 2×103 to 15×103 Pa (15 to 113 Torr) in a space within the glass envelope 201. As the gas 205 as the discharge medium, only inert gas containing no mercury is sometimes used.

Figure 5A:
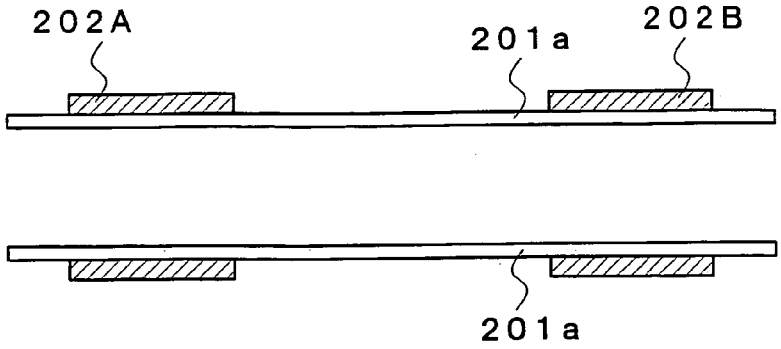
FIGS. 5A–5D are sectional views showing manufacturing steps of the external electrode type discharge lamp of a second embodiment of the present invention.
Figure 5B:
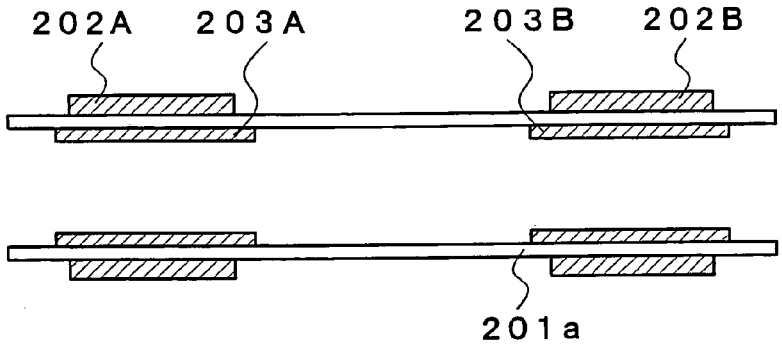

Next, a method of manufacturing the external electrode type discharge lamp of the second embodiment of the present invention will be described with reference to the accompanying drawings. The inventors of the present invention fabricated an external electrode type mercury fluorescent lamp of the second embodiment shown in FIG. 5 in the following manner. First, as shown in FIG. 5A, a tubular glass body 201*a* having both open end faces is prepared, and conductive paste is coated onto portions of the external surface of the glass body 201*a* on its both ends, followed by baking the conductive paste. Thus, the ring-shaped external electrodes 202A and 202B are formed. Subsequently, as shown in FIG. 5B, magnesium acetate solution is coated onto portions of the internal surface of the glass body 201*a* opposite to the external electrodes 202A and 202B, and solvent is vaporized by applying heat to the solution. In order to selectively coat the magnesium acetate solution onto the internal surface of the glass body 201*a*, an area which needed not be coated with the magnesium acetate solution is previously covered with a mask. Furthermore, by baking the magnesium acetate solution at a temperature of about 500 to 600° C. in the atmosphere, the magnesium acetate films 203A and 203B are formed. The magnesium acetate solution used in this embodiment is prepared in such a manner that magnesium acetate is dissolved into alcohol solvent such as butanol, ethanol, or propanol, or aqueous solvent such as pure water, and its viscosity is adjusted. Thus, the magnesium acetate solution is prepared. The magnesium acetate films 203A and 203B formed on the internal surface of the glass body 201*a* are translucent, which are a dense continuous film having a structure in which its constituents are continuously contained.

Figure 5C:
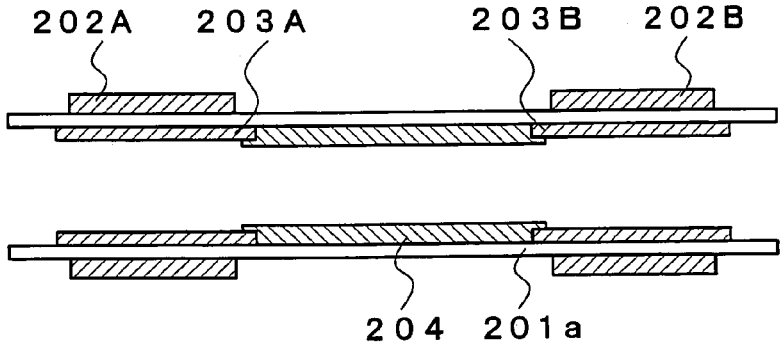
Figure 5D:
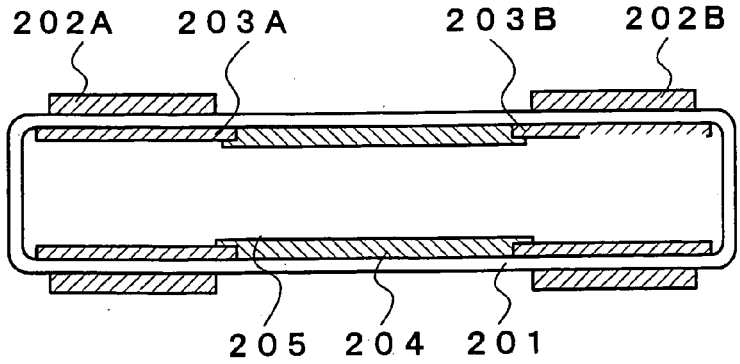

Thereafter, as shown in FIG. 5C, the phosphor layer 204 is formed on the parts of the ring-shaped magnesium oxide films 203A and 103B and on the internal surface of the glass body 201*a* between the magnesium oxide films 203A and 203B, which is not covered with the films 203A and 203B. Furthermore, as shown in FIG. 5D, after the air is once evacuated from the glass body 201*a*, the glass body 201*a* is filled with the xenon gas containing the mercury gas, which is the gas 205 as the discharge medium, and both end faces of the glass body 201*a* is sealed to from the glass envelope 201. In such a manner, the external electrode type mercury fluorescent lamp of this embodiment shown in FIG. 4 is completed.

As to the formation of the external electrodes 202A and 202B, since the electrodes 202A and 202B are formed, for example, by baking the conductive paste in the above described embodiment, the external electrodes 202A and 202B are first formed. There is phosphor material used for the phosphor layer 204, easy to change its characteristic by heat. Accordingly, when a method requiring heating for forming the external electrode is adopted, it is preferable to form the external electrode prior to the formation of the phosphor layer 204. As the external electrodes 202A and 202B, a metal film such as aluminum foil is used, and this metal film is bonded to the external surface of the glass envelope 201 by means of adhesion, whereby it is possible to form the external electrode after the formation of the phosphor layer 204. Specifically, after the phosphor layer 204 is formed, the external electrodes are formed before the gas 205 as the discharge medium is encapsulated. Alternatively, after the gas 205 as the discharge medium is encapsulated, the external electrodes may be formed finally.

Next, a first modification of the external electrode type discharge lamp of the second embodiment and a method of manufacturing the same will be described. This modification has a feature in that the magnesium oxide films 203A and 203B are formed on the internal surface of the glass envelope 201 by use of magnesium nitrate solution. A structure and a method of manufacturing such a structure other than the structure of the films 203A and 203B and the formation thereof are the same as those of the second embodiment. In this modification, the magnesium nitrate solution is coated onto portions of the internal surface of the glass envelope 201 opposite to the external electrodes 202A and 202B, and solvent is vaporized by applying heat to the solution. Furthermore, by baking the magnesium nitrate solution at a temperature of about 500 to 600° C. in the atmosphere, the magnesium oxide films 203A and 203B are formed. The magnesium nitrate solution used in this modification is prepared in such a manner that magnesium oxide is dissolved into suitable solvent, and its viscosity is adjusted. Thus, the magnesium nitrate solution is prepared. The magnesium oxide films 203A and 203B formed in the above described manner are non-porous, which are a dense continuous film having a structure in which its constituents are continuously contained.

As in the case of the conventional mercury fluorescent lamp, the external electrode type mercury fluorescent lamps according to the second embodiment and the first modification performs the discharge and the light-emission by being applied with an AC voltage having a high frequency and a high voltage from the lamp driving circuit 206 to the pair of the external electrodes 202A and 202B. However, in any of these embodiments, the hole-perforation of the glass envelope never occurs in the portions of the external surface of the glass envelope 201 just below the external electrodes 202A and 202B. While there have been heretofore fluorescent lamps causing an inability in lighting instantaneously due to the hole-perforation of the glass envelope at the time about 3000 hours has passed after staring the discharge, a change in the internal surface of the glass envelope 201, which is confirmed visually, is not recognized within about 3000 hours, in the second embodiment.

The reason for this is considered as the follows. As described above, in the external electrode type discharge lamp, the portions of the internal surface of the glass envelope 201 just below the external electrodes 202A and 202B act as the electrode during the discharge. Accordingly, during the lighting, mercury ions are accelerated to be bombarded strongly into the portions of the internal surface of the glass envelope acting as the electrode, and sputter etching occurs. When the portions of the internal surface of the glass envelope are exposed, or alternately when a phosphor layer is directly formed on the internal surface of the glass envelope, the mercury ions etch the internal surface of the glass envelope by sputtering, and penetrate into the inside of the internal surface thereof. Repetition of the sputtering and penetration of the mercury ions reduces the thickness of the glass envelope, and simultaneously elevates a temperature therein, thus decreasing a withstand voltage. Therefore, discharge current increases locally. Thereafter, a thermal runaway rapidly occurs by a positive feedback which means the decrease in the withstand voltage and the increase in the discharge current, and a hole is formed in the glass envelope finally.

Contrary to this, in the foregoing discharge lamp of the second embodiment, the magnesium oxide films 203A and 203B act as a protection film for preventing the accelerated mercury ions from being sputtered onto the glass envelope, and can suppress the hole-perforation phenomenon of the glass envelope. Herein, it is important that the magnesium oxide films 203A and 203B are a dense film having a continuous structure. Specifically, for several metal oxides, the inventors of the present invention tried to use a film formed of metal oxide powders for the protection film. In the same manner as that of forming the phosphor layer, for example, the metal oxide powders are dispersed into solvent, and slip is prepared by adding binder. The slip is coated onto the internal surface of the glass envelope 201, and dried, thus forming the protection film. However, in the case of the protection film formed of powders, mercury is adsorbed in a space between particles of the film, and an amount of the mercury in the gas 205 as the discharge medium decreased with the course of discharge time. A side effect of a short life time of the lamp caused by the decrease in the amount of the mercury appeared. Furthermore, undesirable phenomenon that the mercury adsorbed in the space between the particles eroded the glass envelope is also recognized.

Contrary to this, in the second embodiment, the decrease in the amount of the mercury and the erosion of the glass envelope did not occur. This is because the magnesium oxide film in the second embodiment is a dense film having a continuous structure. In view of the capability to prevent the sputtering of the accelerated mercury ions to the glass envelope, it is expected that the film having the continuous structure has a higher capability of preventing the sputtering of the mercury ions to the glass envelope than the protection film formed by using the powders having a large number of spaces between the particles. In view of this, it is considered that the film having the continuous structure is suitable for the protection film.

Note that in the external electrode type discharge lamp the sputtering by the ions of the gas as the discharge medium against the portion of the internal surface of the glass envelope, which acts as the electrode, naturally occurs even when the discharge medium is only made up of inert gas without including mercury. However, the reason why the hole-perforation phenomenon of the glass envelop is particularly significant when the gas as the discharge medium contains mercury gas is presumed as follows. Specifically, mercury ion is heavier than inert gas typified by Xe, Kr, Ar, Ne and the like, and shows a significant sputtering effect.

Next, a second modification of the external electrode type discharge lamp of the second embodiment and a method of manufacturing the same will be described. This modification has a feature in that the magnesium oxide films 203A and 203B are formed on the internal surface of the glass envelope 201 by use of solution obtained by mixing magnesium acetate and magnesium nitrate. The second modification of the external electrode type discharge lamp of the second embodiment and the method of the same are the same as the second embodiment and the first modification of the second embodiment other than the structure of the magnesium oxide films 203A and 203B and the method of manufacturing the same. In the second modification, the solution obtained by mixing magnesium acetate and magnesium nitrate are coated onto portions of the internal surface of the glass envelope 201 opposite to the external electrodes 202A and 202B, and solvent is vaporized by applying heat to the solution. Furthermore, by baking the solution in the atmosphere, the magnesium oxide films 203A and 203B are formed. The solution obtained by mixing magnesium acetate and magnesium nitrate used in this modification is prepared in such a manner that magnesium acetate and magnesium nitrate are dissolved into suitable solvent, and its viscosity is adjusted. As in the case of the magnesium oxide films in the foregoing second embodiment and the foregoing first modification of the second embodiment, it is confirmed that the effect for preventing the hole-perforation in the glass envelope is recognized. Difference of effects owing to a mixing ratio of the magnesium acetate and the magnesium nitrate is not recognized.

The main two embodiments are described in the above. The protection film made of gadolinium oxide formed by the manufacturing method of the first embodiment and the protection film made of magnesium oxide formed by the manufacturing method of the second embodiment can achieve the object of the present invention as long as these films are formed at least in the portions of the internal surface of the glass envelope just below the external electrodes. Accordingly, since the protection film made of gadolinium oxide and the protection film made of magnesium oxide, which are described here, are translucent, they may be formed over an entire internal surface of the lamp envelope. If such a structure is adopted, when the solution is coated onto the internal surface of the glass envelope in the formation step of the protection film, the portion other than that corresponding to the external electrode needs not to be masked. Accordingly, the formation step of the protection film is simplified by just that much, leading to a decrease in manufacturing cost.

Furthermore, as a matter of course, the present invention can be applied to a discharge lamp using no phosphor layer. In the case of so called a mercury fluorescent lamp using a phosphor layer and gas containing mercury gas, the following structure should be adopted. Specifically, the phosphor layer is generally composed of grains, and a large number of interspaces exist between particles of the phosphor layer. Therefore, in the mercury fluorescent lamp, mercury aggregates in the interspaces between the particles of the phosphor layer, and vapor pressure of the mercury gas in the glass envelope decreases as lighting time advances, resulting in a decrease in lamp brightness. Therefore, an area of the phosphor layer should be as small as possible. Accordingly, in the external electrode type mercury fluorescent lamp, it is preferable not to form a phosphor layer at a portion corresponding to the external electrode.

Still furthermore, though as to the external electrode, the example in which the pair of the electrodes are formed was exemplified, the number of the electrodes is not limited to two. The electrodes just have to be paired in terms of potential, and the number of geometric electrodes may be not less than two. A shape of the electrodes is not limited to a ring shape, but an aperture shape and a spiral shape may be adopted. In addition, a shape of the glass envelope is not limited to be cylindrical, but a planar type discharge lamp using a flat glass envelope with a polygonal section may be adopted. Needless to say, the material of the glass envelope is not limited to the borosilicate glass used in the embodiments.

In a case where the present invention is applied to an external electrode type discharge lamp having % a shape different from the ring shape, this discharge lamp will be described with reference to FIGS. 6A and 6B as a third exemplary embodiment of the present invention. The third embodiment is a case where the present invention is applied to an aperture type discharge lamp in which two band-shaped electrodes along a longitudinal direction of a glass envelope are arranged along a circumference of the glass envelope while providing slit between the electrodes.

Figure 6A:
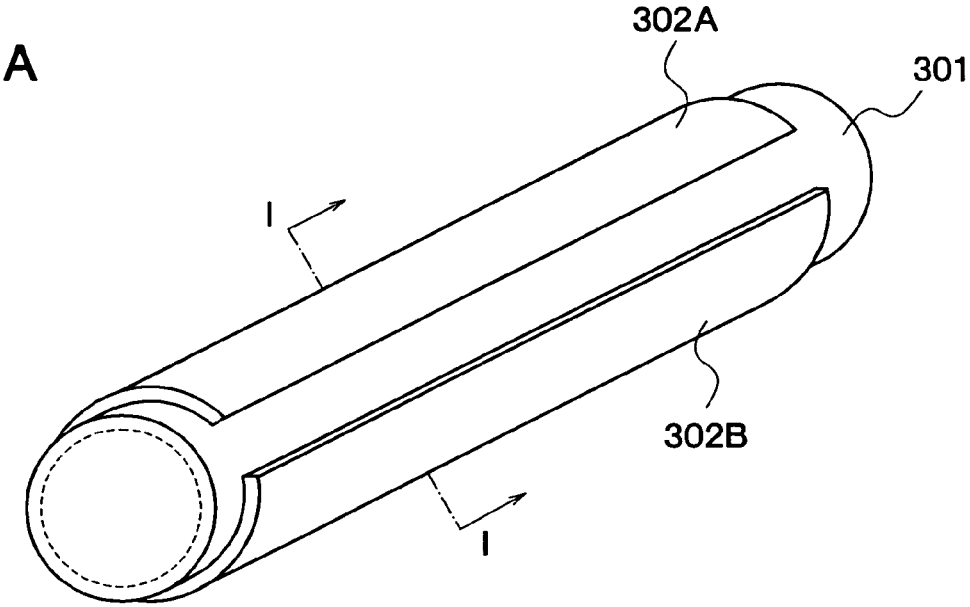
FIG. 6A is a perspective view of an external electrode type discharge lamp of a third exemplary embodiment of the present invention.
Figure 6B:
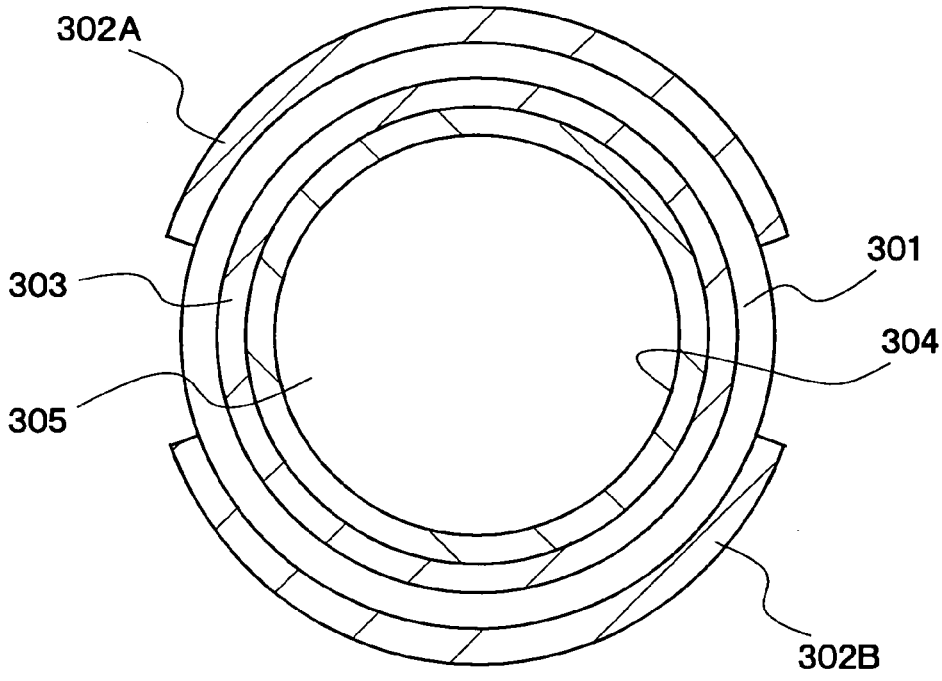
FIG. 6B is a sectional view taken along the line I—I of FIG. 6A.

In the external electrode type discharge lamp of this embodiment, two band-shaped external electrodes 302A and 302B along a longitudinal direction of a sealed cylindrical glass envelope 301 are provided on an external surface of the glass envelope 301 as shown in FIG. 6A. As in the case of the first and second embodiments, borosilicate glass containing K2O.B2O3.SiO2 is used for the glass envelope 301. In general, although a metal is often used as a material of the electrodes, a transparent conductive material such as ITO is sometimes used, and the transparent conductive material is sometimes used in combination with metal material. Furthermore, in this embodiment, a protection film 303 is formed over an entire internal surface of the glass envelope 301 as shown in FIG. 6B. The gadolinium oxide film according to the manufacturing method of the foregoing first embodiment or the magnesium oxide film according to the manufacturing method of the second embodiment is used for this protection film 303. In addition, a phosphor layer 304 is formed on a surface of the protection film 303. Furthermore, as gas 305 as discharge medium, mixed gas of inert gas and mercury gas is encapsulated in a space inside the glass envelope 301.

Also this discharge lamp performs the discharge and the light-emission by being applied with an AC voltage having high frequency and voltage between the pair of the electrodes 302A and 302B. Also in this embodiment, it is suppress to prevent the hole-perforation phenomenon in the portion of the glass envelope 301 just below the external electrodes 302A and 302B.

Although preferred embodiments of the invention have been described with reference to the drawings, it will be obvious to those skilled in the art that various changes or modifications may be made without departing from the true scope of the invention.

What is claimed is:

1. An external electrode type discharge lamp comprising:

a glass envelope encapsulating gas as a discharge medium;

a pair of electrodes provided on an external surface of said glass envelope, to which voltage causing discharge in said glass envelope is applied; and a non-porous oxide film provided in a portion of an internal surface of said glass envelope, said portion including at least a portion opposite to each of said external electrodes, wherein said non-porous oxide film is made of any one of gadolinium oxide and magnesium oxide.

2. An external electrode type discharge lamp comprising:

a hollow airtight glass envelope encapsulating gas as discharge medium;

a pair of electrodes provided on an external surface of said glass envelope, to which voltage causing discharge in said glass envelope is applied; and an oxide film having a continuous structure, provided in a portion of an internal surface of said glass envelope, said portion including at least a portion opposite to each of said external electrodes, wherein said oxide film having said continuous structure is made of any one of gadolinium oxide and magnesium oxide.

3. An external electrode type discharge lamp comprising:

a glass envelope encapsulating gas as a discharge medium;

a pair of electrodes provided on an external surface of said glass envelope, to which voltage causing discharge in said glass envelope is applied; and a non-porous oxide film provided in a portion of an internal surface of said glass envelope, said portion including at least a portion opposite to each of said external electrodes, wherein said non-porous oxide film is formed by baking any one of gadolinium octate solution, gadolinium propionate solution, mixture solution of gadolinium octate and gadolinium propionate, magnesium acetate solution, magnesium nitrate solution, and mixture solution of magnesium acetate and magnesium nitrate.

4. The external electrode type discharge lamp according to claim 3, wherein said non-porous oxide film is provided on an entire internal surface of said glass envelope.

5. The external electrode type discharge lamp according to claim 3, wherein a phosphor layer is formed on said non-porous oxide film.

6. The external electrode type discharge lamp according to claim 3, wherein said gas as said discharge medium contains mercury (Hg) gas.

7. The external electrode type discharge lamp according to claim 3, wherein the pair of external electrodes takes any one of a ring shape in which said electrodes encircle a circumference of said glass envelope, a band shape in which said electrodes extend along a longitudinal direction of said glass envelope, and a spiral shape in which said electrodes are wounded along said longitudinal direction of said glass envelope.

8. An external electrode type discharge lamp comprising:

a hollow airtight glass envelope encapsulating gas as discharge medium;

a pair of electrodes provided on an external surface of said glass envelope, to which voltage causing discharge in said glass envelope is applied; and an oxide film having a continuous structure, provided in a portion of an internal surface of said glass envelope, said portion including at least a portion opposite to each of said external electrodes, wherein said oxide film having said continuous structure is formed by baking any one of gadolinium octate solution, gadolinium propionate solution, mixture solution of gadolinium octate and gadolinium propionate, magnesium acetate solution, magnesium nitrate solution, and mixture solution of magnesium acetate and magnesium nitrate.

9. The external electrode type discharge lamp according to claim 8, wherein the pair of external electrodes takes any one of a ring shape in which said electrodes encircle a circumference of said glass envelope, a band shape in which said electrodes extend along a longitudinal direction of said glass envelope, and a spiral shape in which said electrodes are wounded along said longitudinal direction of said glass envelope.

* * * * *